US005548377A

United States Patent [19]

Kato

[11] Patent Number: 5,548,377

[45] Date of Patent: Aug. 20, 1996

[54] METHOD OF CONTROLLING AN IMAGE FORMING APPARATUS WHEN AN EMERGENCY STOP SIGNAL IS GENERATED

[75] Inventor: Masanori Kato, Kanagawa, Japan

[73] Assignee: Fuji Xerox Co., LTD., Tokyo, Japan

[21] Appl. No.: 404,274

[22] Filed: Mar. 14, 1995

[30] Foreign Application Priority Data

Apr. 19, 1994 [JP] Japan ..... 6-080161

[51] Int. Cl.[6] ..... G03G 15/00

[52] U.S. Cl. ..... 355/207

[58] Field of Search ..... 355/265, 268, 355/207

[56] References Cited

U.S. PATENT DOCUMENTS

| | | | |
|---|---|---|---|
| 3,778,572 | 12/1973 | Matsui et al. | 200/61.45 |
| 4,900,925 | 2/1990 | Andres et al. | 250/231 |
| 5,092,172 | 3/1992 | Overman et al. | 73/517 |
| 5,155,307 | 10/1992 | Breed et al. | 200/61.45 |
| 5,192,838 | 3/1993 | Breed et al. | 200/61.45 |
| 5,231,253 | 7/1993 | Breed et al. | 200/61.45 |
| 5,233,141 | 8/1993 | Breed | 200/61.45 |
| 5,283,402 | 2/1994 | Green | 200/61.45 |
| 5,360,956 | 11/1994 | Shitanoki | 200/61.45 |
| 5,378,865 | 1/1995 | Reneau | 200/61.45 |
| 5,450,049 | 9/1995 | Bachmann | 335/205 |

FOREIGN PATENT DOCUMENTS

| | | |
|---|---|---|
| 4-67160 | 3/1992 | Japan . |
| 5-165287 | 7/1993 | Japan . |
| 624442 | 8/1994 | Japan . |

*Primary Examiner*—Joan H. Pendegrass
*Assistant Examiner*—Quana Grainger
*Attorney, Agent, or Firm*—Finnegan, Henderson, Farabow, Garrett & Dunner, L.L.P.

[57] ABSTRACT

A method of controlling an image forming apparatus which employs a two-component developing system in which toner is charged with the same polarity as a charging polarity of a photoreceptor, and in which apparatus a charging voltage and a developing bias voltage are applied after the photoreceptor is driven, comprising the steps of stopping drive of the photoreceptor and application of the charging voltage and the developing bias voltage, when an emergency stop signal is generated; and raising the developing bias voltage before starting the drive of the photoreceptor, when the image forming apparatus is restarted.

1 Claim, 4 Drawing Sheets

METHOD OF CONTROLLING AN IMAGE FORMING APPARATUS WHEN AN EMERGENCY STOP SIGNAL IS GENERATED

BACKGROUND OF THE INVENTION

The present invention relates to the timing of applying a developing bias voltage to a component of a xerography image forming apparatus, such as a copying machine, a facsimile device, or a printer, when it is stopped in an emergency.

A copying machine based on xerography repeats a copying process, to thereby successively copy an image on an original document onto a transfer paper. The copying process consists of charging the photoreceptor, exposing the photoreceptor to the document image, developing a latent electrostatic image formed on the photoreceptor, transferring the developed toner image onto a transfer paper, fixing the transferred image, cleaning the photoreceptor. When receiving an emergency stop signal during a copying operation, a conventional image forming apparatus of this type, disclosed in Published Unexamined Japanese Patent Application No. Hei. 4-67160, for example, operates in the following way. In a state when the image forming process is not yet completed, the charger and the photoreceptor are stopped, but the application of the developing bias voltage is continued to prevent toner from being scattered and toner from being mixed (in case of the color development), when not stopped immediately.

In the conventional copying system, in an emergency, it is desirable to quickly stop all the components and the bias power source as well. Immediately after the machine stops in an emergency, a user or a service man may make an access to the inside of the machine for fixing the machine. In this case, it is essential to protect him from electric shock caused by the application of the high developing bias voltage.

In a recent trend in this field, in view of the improvement of the picture quality, carriers used for the two-component developer are reduced in particle diameter or size, the gap between the photoreceptor and the developing roll is also reduced, and an AC bias voltage is applied to the developing unit. This small sized carrier is weak in magnetic holding force. When an intensive electric field is applied to the carrier, the carrier is easily moved to stick to the photoreceptor. If the machine is driven in a state that the carriers are sticking to the photoreceptor, the blade of the cleaning unit accumulatively collects the carrier. These carriers have an adverse influence on the subsequent steps of the image forming process. For example, the carrier may scratch the photoreceptor or enter the transfer unit, possibly causing a leak of the carrier.

SUMMARY OF THE INVENTION

With the view of solving the above problem, the present invention has an object to provide a method of controlling an image forming apparatus operating such that to stop the machine in case of emergency, all the components and the developing bias power source are immediately stopped, and to restart the machine after the emergency stop, the developing bias power source is driven before the photoreceptor is driven, to thereby return to the developing roll carrier that stuck to the photoreceptor at the time of the emergency stop, whereby the disadvantages caused by carrier sticking to the photoreceptor are removed.

To achieve the above object, there is provided a method of controlling an image forming apparatus which employs a two-component developing system in which toner is charged with the same polarity as a charging polarity of a photoreceptor, and in which apparatus a charging voltage and a developing bias voltage are applied after the photoreceptor is driven, comprising the steps of stopping drive of the photoreceptor and application of the charging voltage and the developing bias voltage, when an emergency stop signal is generated; and raising the developing bias voltage before starting the drive of the photoreceptor, when the image forming apparatus is restarted.

In the present invention, all of the power to the image forming apparatus is stopped in case of shutdown. When the image forming apparatus is restarted, at first, a polarized voltage same as the image forming voltage is applied as a developing bias voltage, and thereafter the photoreceptor is driven. The magnetic carriers on the developing sleeve attracted by the surface voltage of the photoreceptor are again attracted to the developing sleeve upon stopping the photoreceptor. Therefore, by the proceeding rotation of the photoreceptor, the magnetic carriers are prevented from being attracted to the photoreceptor. As a result, the a problem of attraction of the magnetic carriers onto the surface of the photoreceptor is prevented.

In the present invention the developing bias usually turned on in synchronism with a photoreceptor charging power source. At the start of driving the photoreceptor, no electric field is developed between the developing roll and the photoreceptor. Immediately before the photoreceptor is charged, the developing bias voltage is applied to the related component. To restart the image forming apparatus after the emergency stop, at the developing position, an electric field is generated so as to cause carrier to move toward the developing roll in a state that the photoreceptor is being stopped. Thereafter, a developing bias voltage is generated at such a timing as to cause the photoreceptor to be driven.

DETAILED DESCRIPTION OF THE PREFERRED EMBODIMENTS

Figure 1:
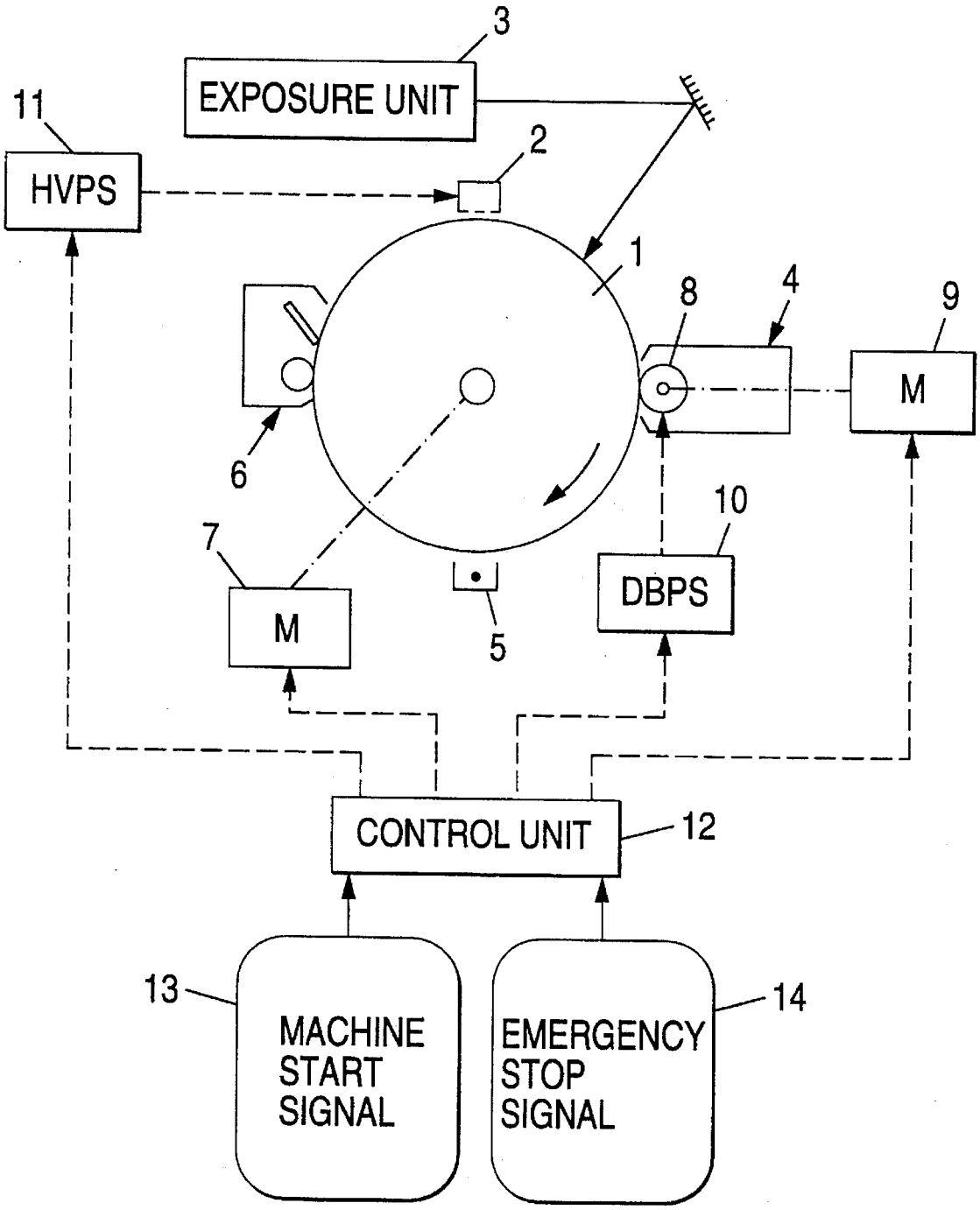
FIG. 1 shows an overall construction of an embodiment of a method of controlling an image forming apparatus according to the present invention.
Figure 2:
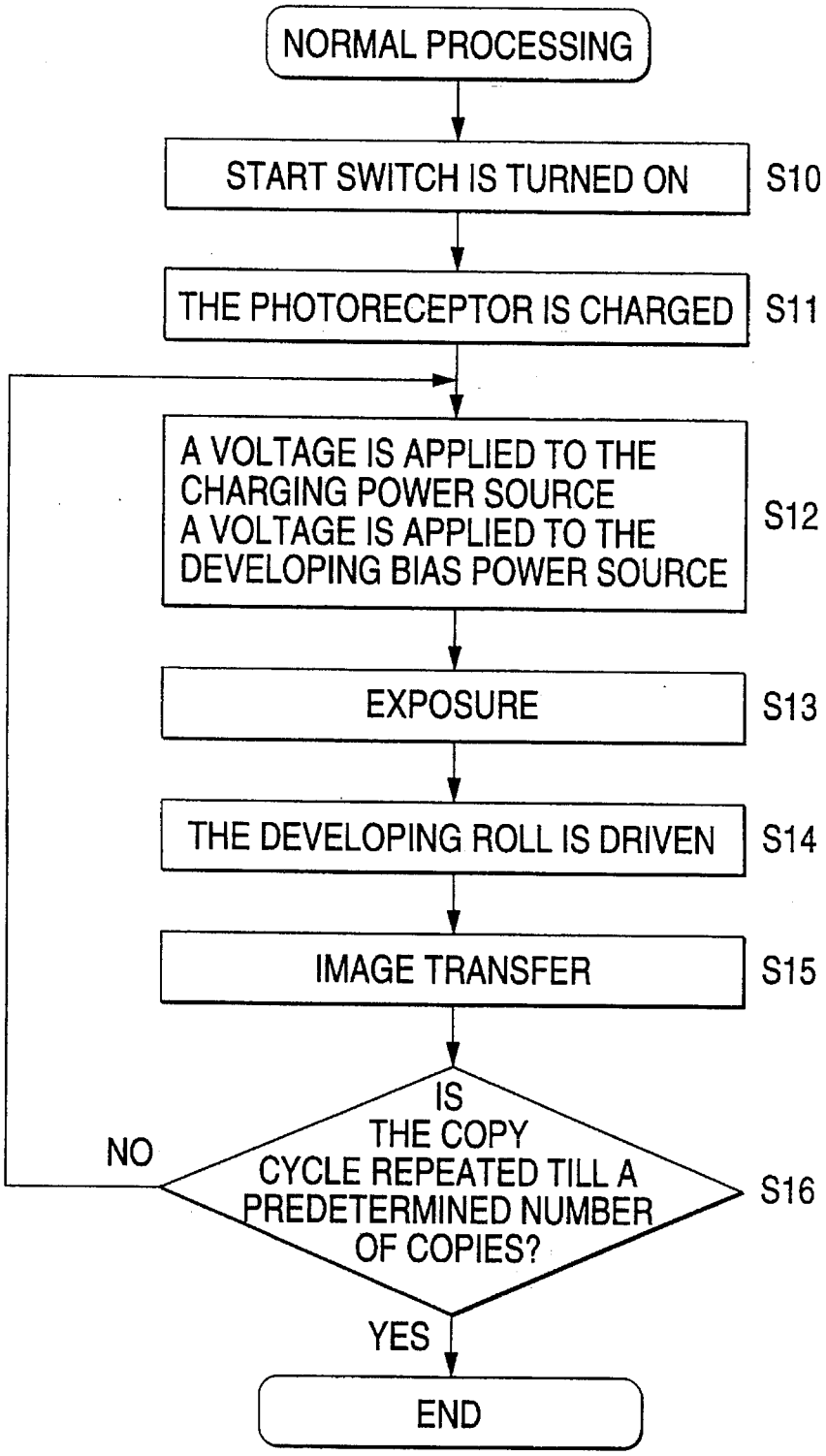
FIG. 2 is a flowchart showing a process flow in the controlling method of the present invention.
Figure 3:
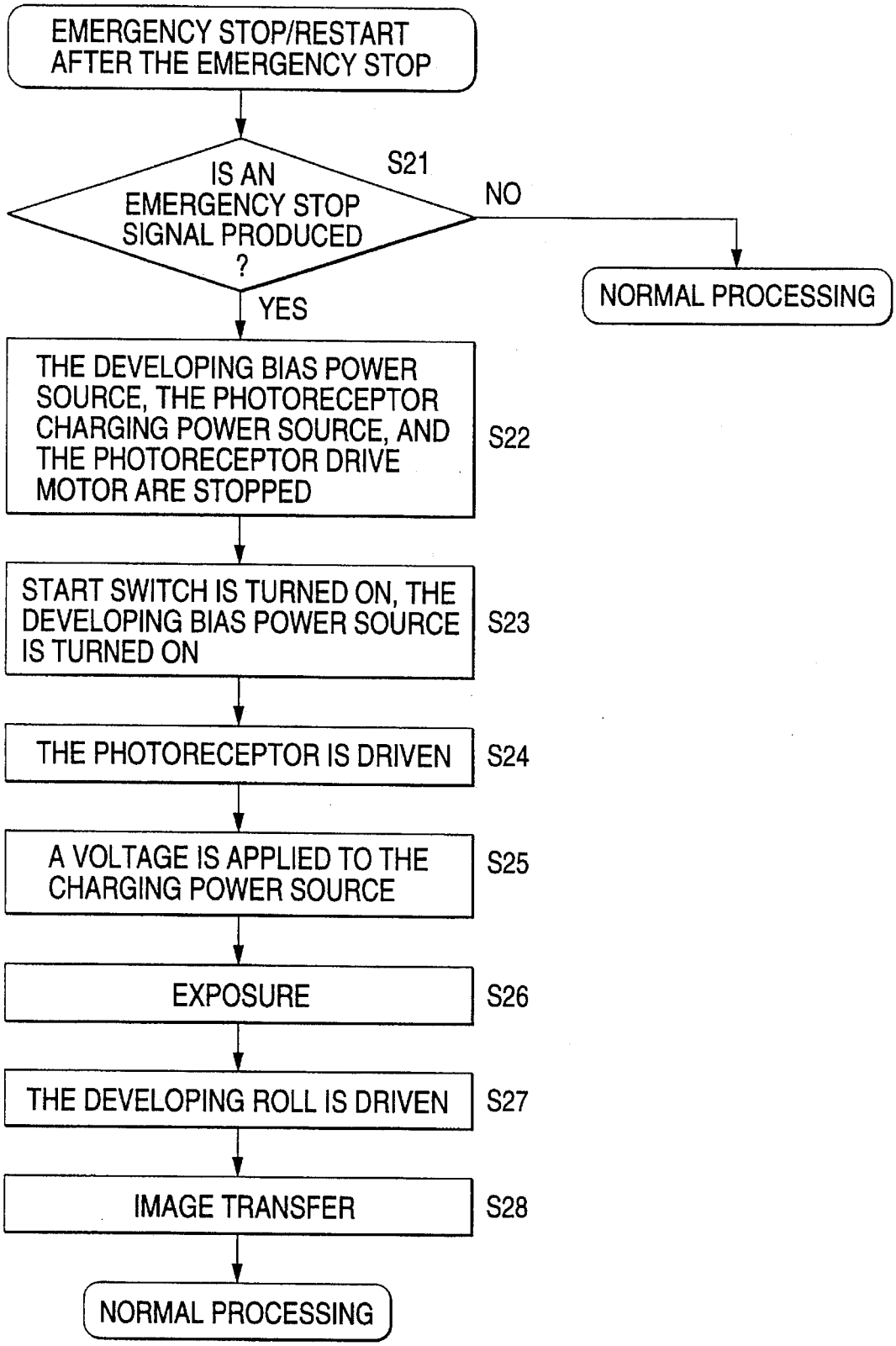
FIG. 3 is a flowchart showing another process flow in the controlling method of the present invention.
Figure 4:
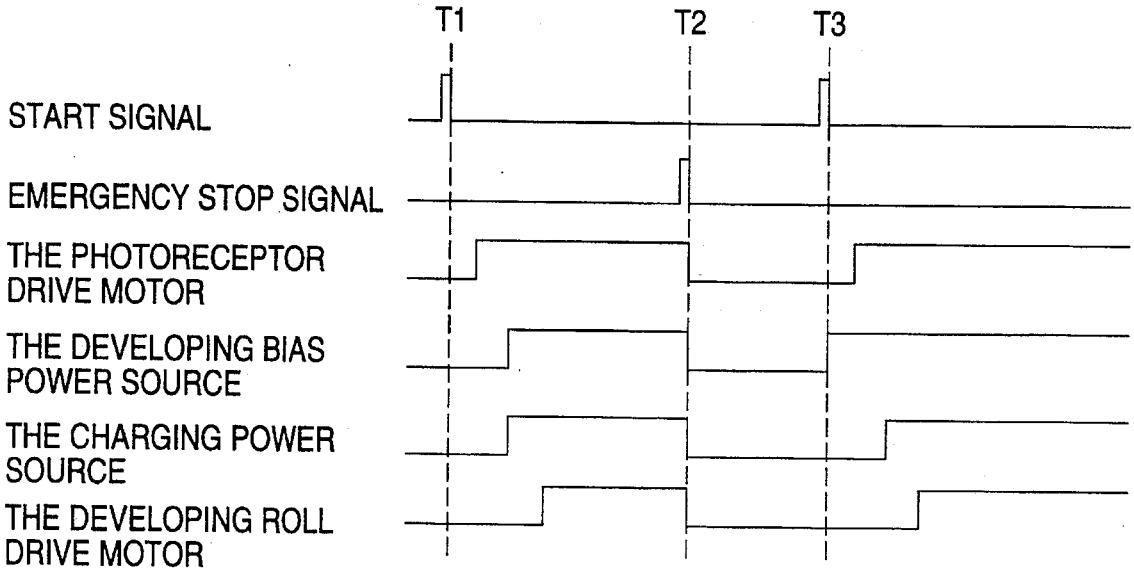
FIG. 4 is a timing chart showing the operation of the image forming apparatus when a developing bias voltage is applied.

The preferred embodiment of the present invention will be described with reference to the accompanying drawings. FIGS. 1 through 4 show an embodiment of the present invention. Of these figures, FIG. 1 shows an overall construction of the embodiment, and FIGS. 2 and 3 show flowcharts showing process flows in a control unit shown in FIG. 1, and FIG. 4 is a timing diagram showing the application of a developing bias voltage.

In FIG. 1, a charging unit 2, an exposure unit 3, a developing unit 4, a transfer unit 5, and a cleaning unit 6 are disposed around a photoreceptor 1. The photoreceptor 1 is driven by a photoreceptor drive motor 7 to rotate in the direction of an arrow. A two-component developer is contained in the developing unit 4. A developing roll 8 is disposed in proximity to the photoreceptor 1, with a predetermined gap being present therebetween. Toner supplied to the developing roll 8 is charged in the same polarity as the charging polarity of the photoreceptor 1, to thereby develop a latent electrostatic image. The developing roll 8 is driven to rotate by a developing roll drive motor 9. The developing roll 8 is applied with a developing bias voltage from a developing bias power source 10. A charging voltage is applied from a photoreceptor charging power source 11 to the charging unit 2.

The photoreceptor 1 is uniformly charged by the charging unit 2 while being rotated in the direction of an arrow. A latent electrostatic image corresponding to an image on an original document is formed on the photoreceptor 1 by the exposure unit 3. The latent electrostatic image is developed by the developing roll 8 into a toner image. The toner image is transferred onto the incoming transfer member that is transported by the transfer unit 5, and fixed by a fixing unit (not shown). After the photoreceptor 1 is cleaned by the cleaning unit 6, and discharged, and subsequently the copy cycle as mentioned above is repeated successively.

In the present invention, a control unit 12 sets a timing of the application of a developing bias voltage to be described later, in accordance with a machine start signal 13 and an emergency stop signal 14, and outputs control signals to the photoreceptor drive motor 7, the developing roll drive motor 9, the developing bias power source 10, and the photoreceptor charging power source 11.

FIGS. 2 and 3 show processing flows in the control unit 12.

In FIG. 2 showing a normal processing flow, a start switch is first turned on, the photoreceptor drive motor 7 is driven (step S11), and after a preset time, a voltage is applied to the developing bias power source 10 and the photoreceptor charging power source 11 (step S12). In this case, at the developing position, the developing bias voltage is applied immediately before the photoreceptor 1 is charged. With the application of the bias voltage, carriers being nipped for development between the photoreceptor 1 and the developing roll 8 are not meaninglessly moved toward the photoreceptor 1 and not consumed. The exposure, drive of the developing roll 8, and image transfer are carried out, and the copy cycle is repeated till a predetermined number of copies are produced.

FIG. 3 shows a processing flow for an emergency stop/restart after the emergency stop. During the normal processing of FIG. 2, if an emergency stop signal is produced (step S21), the developing bias power source 10, the photoreceptor charging power source 11 and the photoreceptor drive motor 7 are simultaneously stopped in operation (step S22). At this time, the developing bias voltage quickly drops, but the surface potential on the photoreceptor 1 gradually drops through the dark attenuation. Between the developing roll 8 and the photoreceptor 1, an electric field causing carrier to move toward the photoreceptor 1 is developed, so that carrier under development in the fixed nip area (developing nip) sticks to the photoreceptor 1.

To restart the image forming apparatus immediately after the emergency stop, at a step S23, the developing bias power source is turned on simultaneously with the switch on of the start switch. That is, when the photoreceptor 1 is being stopped, an electric field causing carrier to move toward the developing roll 8 is generated, to thereby return carrier sticking to the photoreceptor 1 to the developing roll 8. Following this, the photoreceptor 1 is driven at a step S24. The operation of charging the photoreceptor 1 starts after a preset time from the drive of the photoreceptor 1 (step S25). Then, the drive of the developing roll 8, and the image transfer are carried out, and the machine returns to the normal processing of FIG. 2.

FIG. 4 is a timing chart showing the operation of the image forming apparatus when a developing bias voltage is applied. To start the image forming apparatus in a normal state at a time point $T_1$, after the photoreceptor 1 is driven, the developing bias voltage and the charging voltage are simultaneously applied. When an emergency signal is generated at a time point $T_2$, the developing bias, the photoreceptor charging voltage, and the photoreceptor drive motor 7 are simultaneously stopped. At a time point $T_3$, if a start signal is present, the developing bias power source is driven before the photoreceptor 1 is driven. After a preset time elapses from the drive of the photoreceptor 1, the operation of charging the photoreceptor 1 starts.

The term "emergency stop" thus far used means an abnormal state of the image forming apparatus in which immediate stop of the photoreceptor drive is required. Examples of the abnormal state are paper jamming on the photoreceptor, failure of the photoreceptor drive motor, and the like. Particularly in the case of the paper jamming, there is a possibility that a paper enters the cleaning unit, and cannot be removed therefrom by a user. To avoid this, it is necessary to stop the drive of the photoreceptor before the paper enters the cleaning unit. At the same time, the developing bias power source must also be stopped for the same reason.

As seen from the foregoing description, the present invention succeeds in providing a method of controlling an image forming apparatus operating such that to stop the machine in case of emergency, all the components and the developing bias power source are immediately stopped, and to restart the machine after the emergency stop, the developing bias power source is driven before the photoreceptor is driven, to thereby return to the developing roll carrier that stuck to the photoreceptor at the time of the emergency stop, whereby the disadvantages caused by carrier sticking to the photoreceptor are removed. Further, in the method of controlling such an image forming apparatus, without any special means and mechanism, it is possible to overcome the disadvantages caused by carrier that sticks to the photoreceptor when the image forming apparatus is restarted immediately after the emergency stop. This is realized by switching the timing of applying the developing bias voltage to another.

What is claimed is:

1. A method of controlling an image forming apparatus which employs a two-component developing system in which toner is charged with the same polarity as a charging polarity of a photoreceptor, and in which apparatus a charging voltage and a developing bias voltage are applied after said photoreceptor is driven, comprising the steps of:

stopping drive of said photoreceptor and application of the charging voltage and the developing bias voltage when an emergency stop signal is generated; and raising the developing bias voltage before starting the drive of said photoreceptor, when said image forming apparatus is restarted.

* * * * *